US005913293A

United States Patent [19]

Ochiai

[11] Patent Number: 5,913,293

[45] Date of Patent: Jun. 22, 1999

[54] OIL PASSAGE STRUCTURE FOR ENGINE

[75] Inventor: Hiroaki Ochiai, Kyoto, Japan

[73] Assignee: Mitsubishi Jidosha Kogyo Kabushiki Kaisha, Tokyo, Japan

[21] Appl. No.: 09/069,859

[22] Filed: Apr. 30, 1998

[30] Foreign Application Priority Data

May 1, 1997 [JP] Japan ..... 9-113824

[51] Int. Cl.[6] ..... F01M 1/06

[52] U.S. Cl. ..... 123/90.33; 123/196 M; 184/6.5; 184/6.9

[58] Field of Search ..... 123/90.33, 90.34, 123/90.35, 196 R, 196 M; 184/6.5, 6.9

[56] References Cited

U.S. PATENT DOCUMENTS

| | | | |
|---|---|---|---|
| 3,782,357 | 1/1974 | Kuhn et al. | 123/90.33 |
| 4,441,465 | 4/1984 | Nakamura | 123/90.33 |
| 4,928,641 | 5/1990 | Niizato et al. | 123/196 M |
| 5,161,495 | 11/1992 | Saito | 123/90.33 |
| 5,195,472 | 3/1993 | Jacques et al. | 123/90.33 |
| 5,220,891 | 6/1993 | Nakamura et al. | 123/90.33 |

FOREIGN PATENT DOCUMENTS 61-173706 U 10/1986 Japan .

*Primary Examiner*—Weilun Lo

[57] ABSTRACT

An oil passage structure of an engine is provided, wherein oil is prevented from being drained from an oil passage when the engine is stopped, and air mixed into the oil in the oil passage can be surely removed. The oil passage structure includes a first oil path or paths for supplying oil to lash adjusters of a cylinder head of the engine, a second oil path that communicates with an oil pump and supplies oil into an upstream portion of each first oil path, and an air vent passage that is connected to a downstream portion of each first oil path and has an opening through which the air is to be removed from the oil path. The second oil path and the opening of the air vent passage are located at higher positions than the first oil path(s).

7 Claims, 6 Drawing Sheets

OIL PASSAGE STRUCTURE FOR ENGINE

FIELD OF THE INVENTION

The present invention relates to an oil passage structure for supplying oil to hydraulically operated portions of a cylinder head of an engine, such as to hydraulic tappets used in a valve system of an engine.

BACKGROUND OF THE INVENTION

Internal combustion engines of automobiles are generally provided with rocker arms that pivot or swing about hydraulic tappets (lash adjusters) as hydraulically operated portions, camshafts that are rotated to rock the rocker arms, and intake and exhaust valves that are driven by these rocker arms.

To supply oil to the lash adjusters, pressurized oil is introduced from an oil pump that is driven upon start of the engine, into oil passages that lead to the lash adjusters. When the engine is stopped, however, the oil pump is stopped, and the surface of the oil in the oil passage is lowered. If the engine is restarted in this state, the oil pump is driven again, but the supply of the oil to the lash adjusters is delayed because of the lowered level of the oil in the oil passage. In the case where air is mixed into the oil in the oil passage, the air enters the lash adjusters, and causes undesirable noises during operation of the lash adjusters.

One type of oil supply device has been proposed, in which an oil inlet portion of an oil passage at which oil is introduced into the passage is located at a higher position than the other portion of the oil passage, as disclosed in Laid-open Publication No. 61-173706 of Japanese Utility Model Application. In this conventional oil supply device, the oil is prevented from being discharged from the oil passage even when the engine is stopped, and the oil can be readily supplied to suitable portions of the engine without delay when the engine is restarted.

In the conventional oil supply device as disclosed in the above-identified publication No. 61-173706, an air vent hole is formed at the oil inlet portion of the oil passage, so that air can be removed or discharged through the air vent hole at the time when the oil is introduced into the oil passage. Therefore, even if air is contained in the oil to be supplied to the oil passage, the air is removed in advance upon supply of the oil, and oil that is free of air is supplied to the oil passage. Consequently, air is prevented from entering the lash adjusters to which the oil is supplied.

In the conventional oil supply device as described above, however, air is removed or ejected at the time when the oil is supplied to the oil passage. Therefore, air, that was not removed at the oil inlet portion, is undesirably introduced into the oil passage. In the case where the oil mixed with air is supplied to the oil passage, it is difficult to remove the air from the oil after it enters the oil passage, and the air remains in the oil passage. Thus, in the conventional oil supply device, air may not be surely removed or ejected from the oil passage, and undesirably enters the lash adjusters, thus causing problems during operations of the lash adjusters.

SUMMARY OF THE INVENTION

It is therefore an object to provide an oil passage structure for an engine, wherein oil is prevented from being drained out of an oil passage when the engine is stopped, and wherein air can be surely removed from the oil passage.

To accomplish the above object, the present invention provides an oil passage structure of an engine provided with an oil passage for supplying oil to hydraulically operated portions of a cylinder head of the engine, comprising: an oil inlet passage that communicates, at a first end thereof, with an upstream end portion of the oil passage, and communicates, at a second end thereof, with an oil pressure source, the oil inlet passage being located at a higher position than the oil passage; and an air vent passage that communicates, at a first end thereof, with a downstream end portion of the oil passage, and includes an air vent opening formed at a second end thereof, the air vent opening being located at a higher position than the oil passage.

In the oil passage structure of the present invention as described above, the oil inlet passage, through which oil is introduced into the oil passage, is provided on the upstream side of the oil passage, and the air vent passage with an opening, through which air is removed, is provided at the downstream portion of the oil passage, such that the oil inlet passage and the opening are located at higher positions than the oil passage. In this arrangement, when the engine is stopped, the oil is prevented from being drained from the oil passage into the oil inlet passage or air vent passage. When the engine is restarted, therefore, the oil can be readily supplied to hydraulically operated portions that require oil pressures, thus making it unnecessary to wait for supply of oil from the oil pressure source, and avoiding rotation of hydraulic components of the engine with no oil supplied thereto. Further, even when oil mixed with air is introduced into the oil passage, the air is discharged to the outside through the opening of the air vent passage, thereby avoiding problems that would otherwise occur due to air entering the hydraulically operated portions of the engine.

In one preferred form of the invention, a cam cap, which is attached to an upper portion of the cylinder head, is provided for supporting at least one camshaft, and the oil inlet passage and the air vent passage are formed in the cam cap. In this case, the oil inlet passage and the opening of the air vent passage can be maintained at higher positions than the oil passage, regardless of the angle of installation of the engine on the vehicle. Even if the angle of installation of the engine is changed, there is no need to change the cylinder head, and only the position and angle of the oil inlet passage and/or air vent passage formed in the cam cap may be changed to deal with the change in the angle of installation. Thus, a significantly change or changes need not be made with the main body of the engine, which leads to reduction in the cost of manufacturing the engine.

In another preferred form of the invention, another oil passage is provided at an upstream side of the oil inlet passage, and provided with a flow-restricting member. In this arrangement, the oil in the oil inlet passage is prevented from rapidly flowing back toward the oil pressure source when the engine is stopped.

DETAILED DESCRIPTION OF THE PREFERRED EMBODIMENT

The present invention will become more fully understood from the detailed description given hereinbelow and the accompanying drawings which are given by way of illustration only, and thus are not limitative of the present invention.

Figure 1:
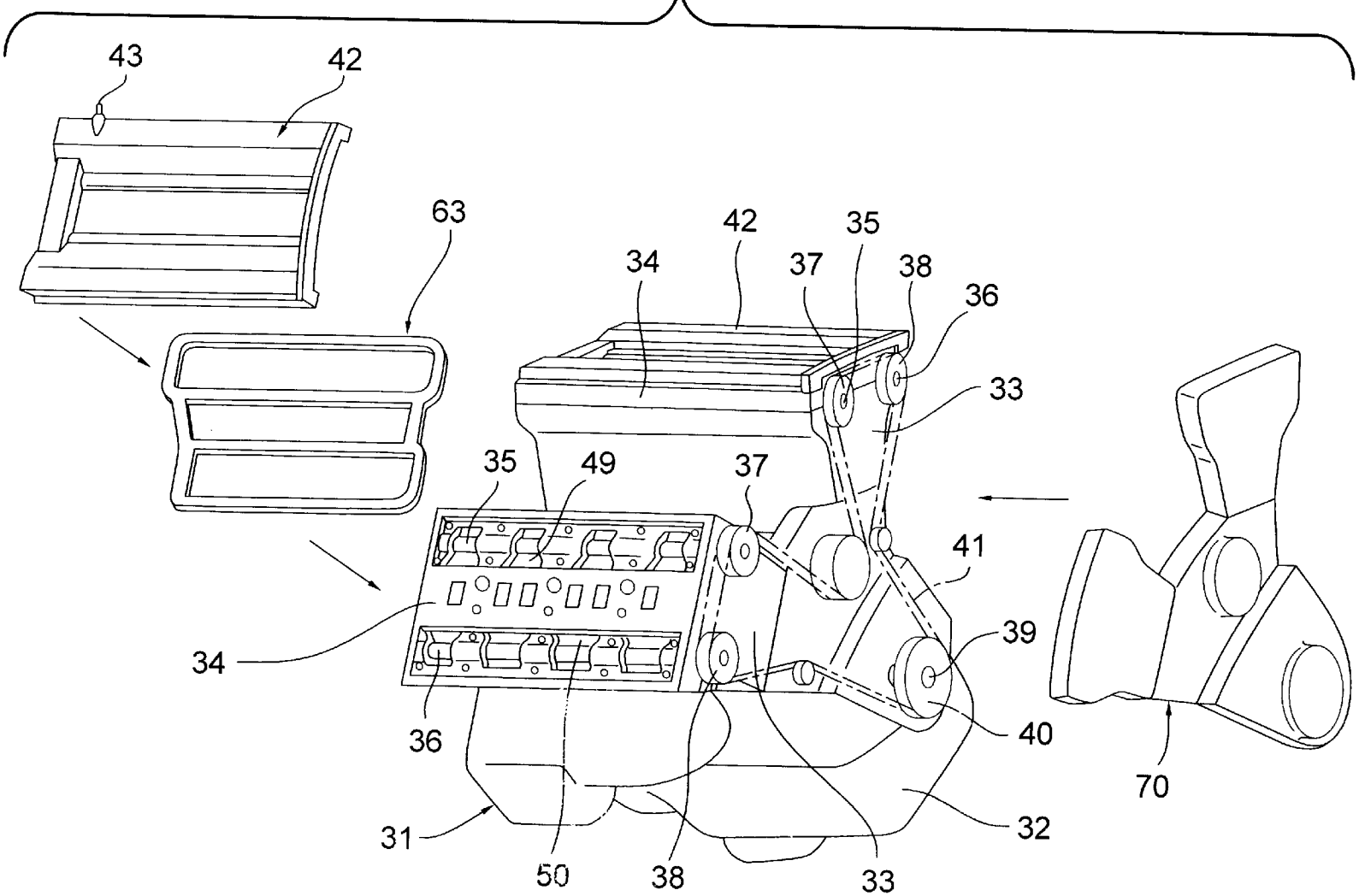
FIG. 1 is an exploded perspective view of a V-shaped, six-cylinder, direct fuel injection type engine which employs an oil passage structure of an engine according to one embodiment of the present invention.
Figure 2:
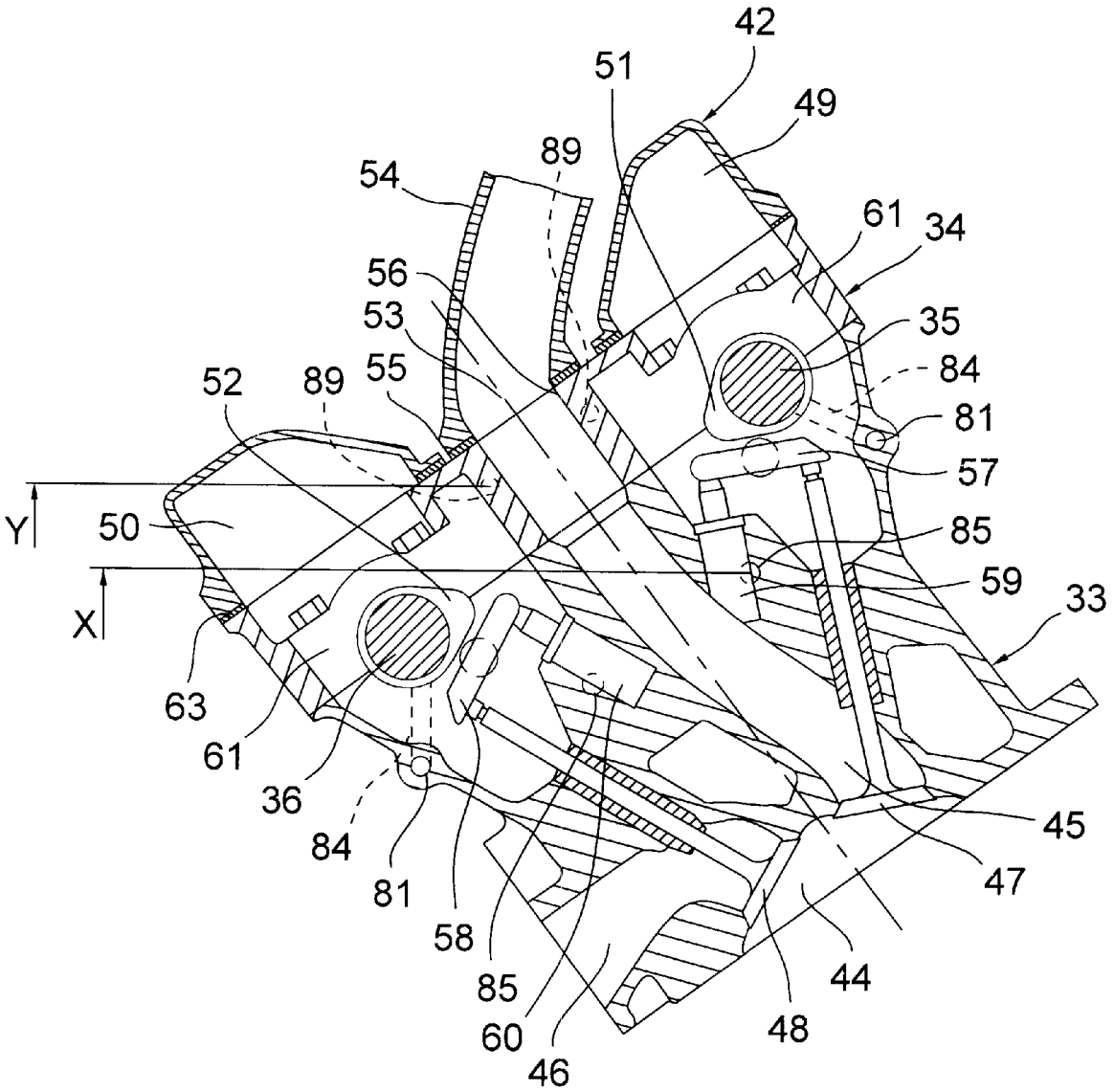
FIG. 2 is a vertical cross-sectional view showing a cylinder head portion of the engine.
Figure 3:
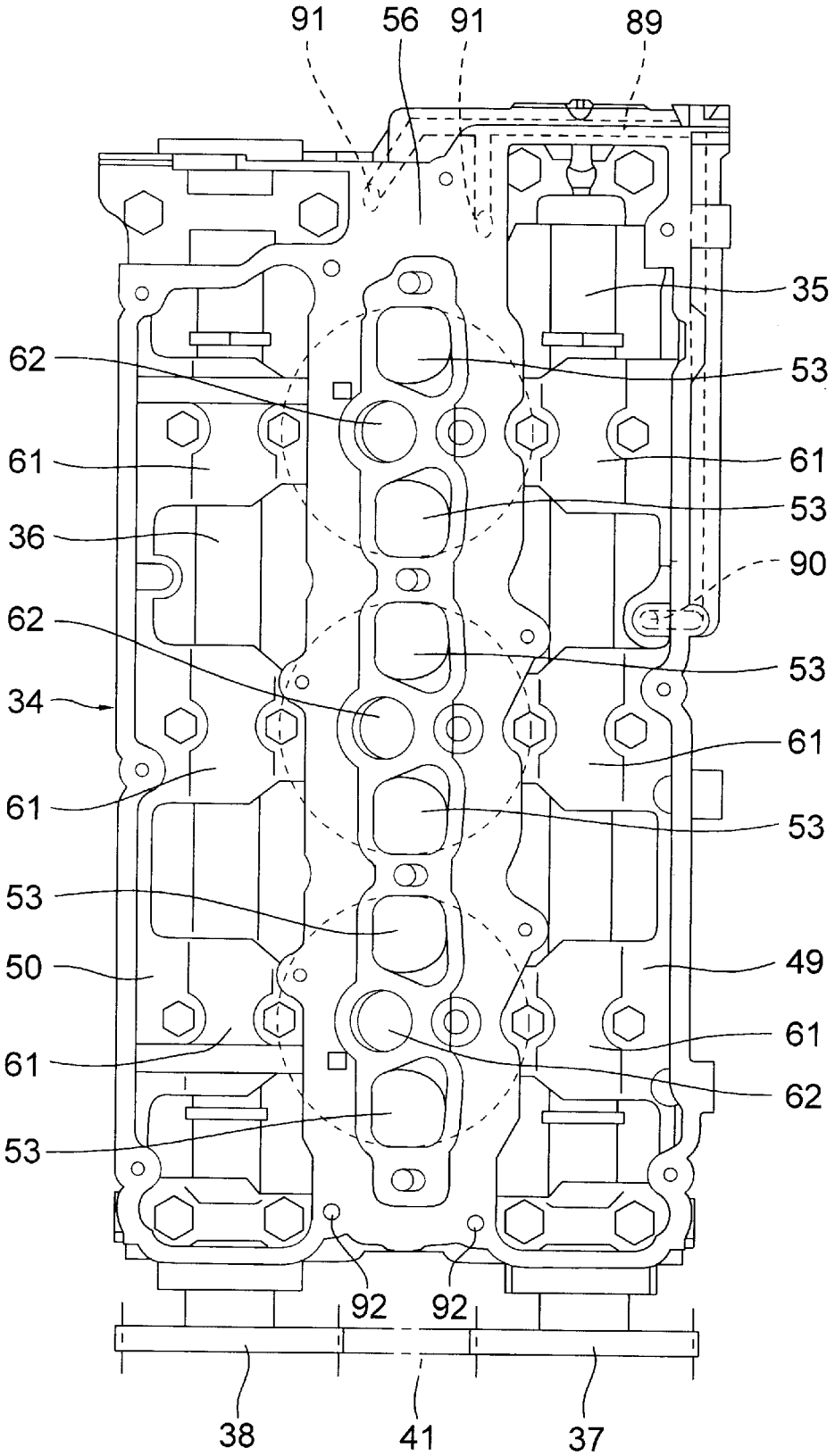
FIG. 3 is a plan view showing a cam cap plate along with the interior of the engine.
Figure 4:
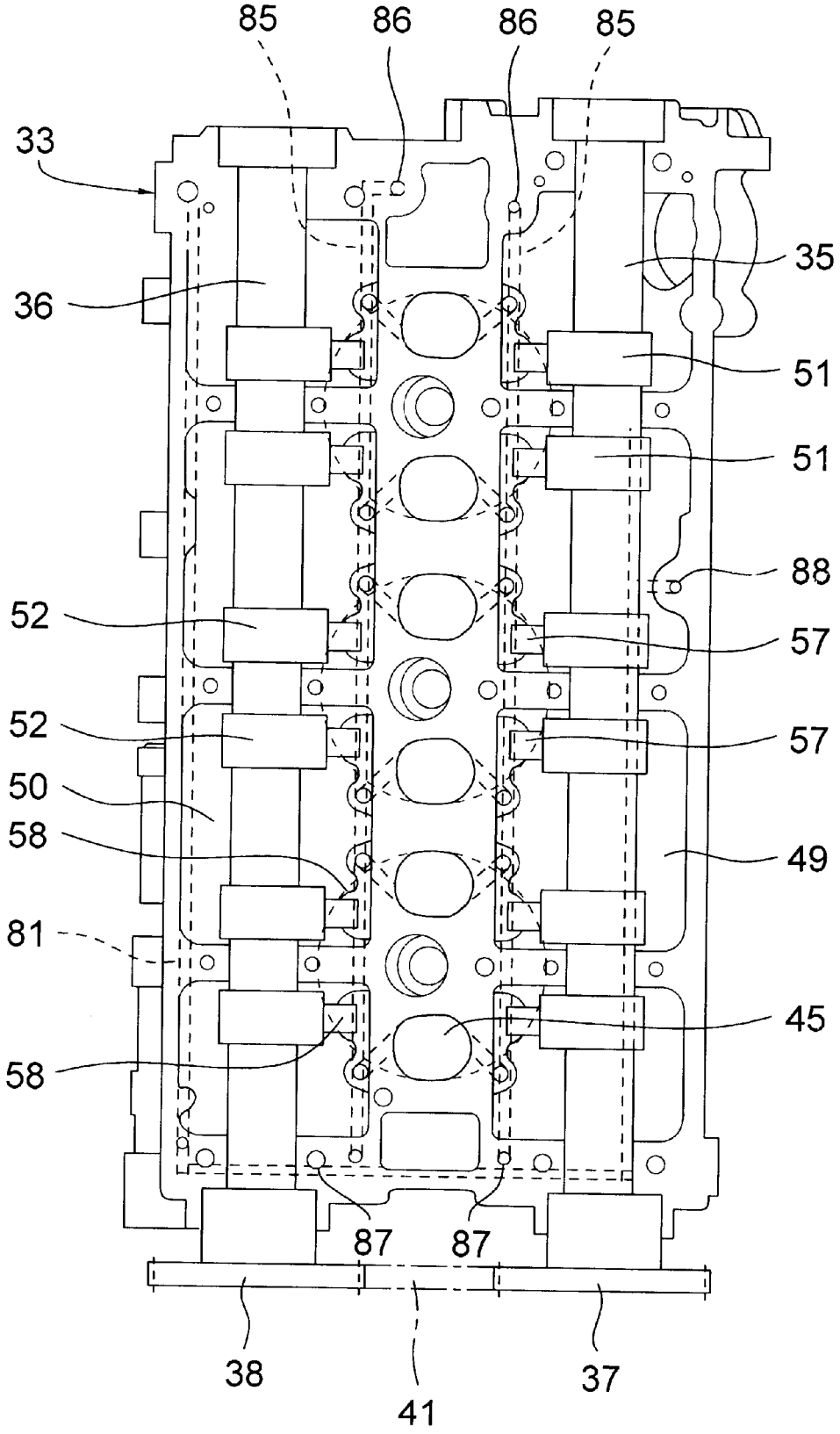
FIG. 4 is a plan view showing a cylinder block along with the interior of the engine.
Figure 5:
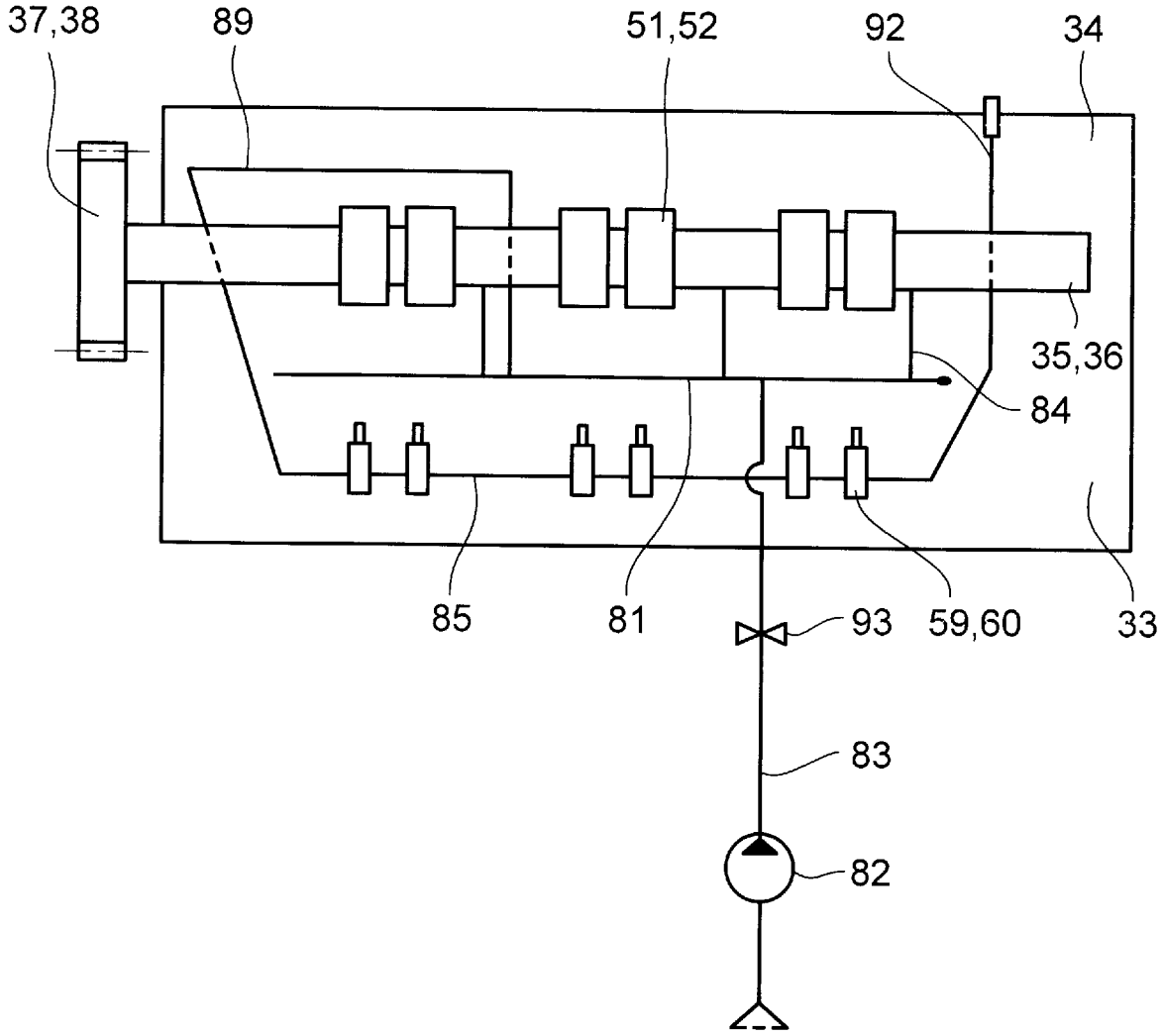
FIG. 5 is a schematic view showing the oil passage structure of the embodiment of FIGS. 1–4 of the present invention, as viewed from a side face of the engine.
Figure 6:
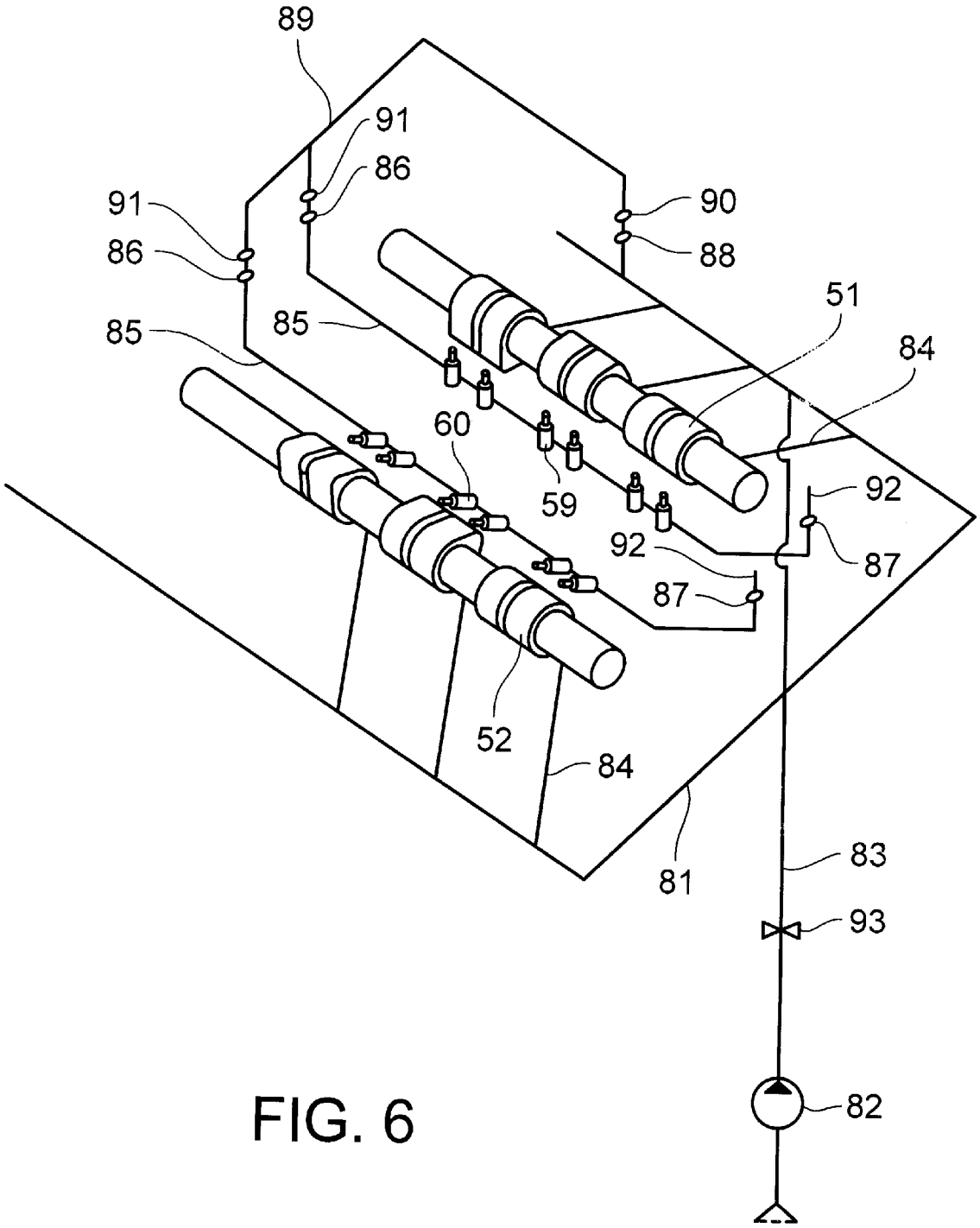
FIG. 6 is a perspective view schematically showing the oil passage structure of the embodiment of FIGS. 1–4 of the present invention.

FIG. 1 is an exploded perspective view of a V-shaped, six-cylinder, fuel injection type engine that employs an oil passage structure of an engine according to one embodiment of the present invention. FIG. 2 is a vertical cross-sectional view of a cylinder head portion of the engine, and FIG. 3 is a plan view showing a cam cap plate along with the interior of the engine. FIG. 4 is a plan view showing a cylinder block along with the interior of the engine, and FIG. 5 is a schematic view of the oil passage structure of the engine of the present embodiment, as viewed from one side face of the engine. FIG. 6 is a perspective view schematically showing the oil passage structure of the engine of the present embodiment.

The engine of the present embodiment is a V-shaped, six-cylinder, DOHC (double overhead camshaft) gasoline engine having two banks, each including three cylinders, as shown in FIG. 1. This engine is of direct fuel injection type, wherein a pressurized fuel is directly injected into a combustion chamber while the air is supplied from upright intake ports into the combustion chamber, so that a mixture of the fuel and the air is ignited or burned in the combustion chamber. It is to be noted that each structure shown in FIG. 2 through FIG. 6 is that of a cylinder head portion on the side of the left bank as viewed in FIG. 1.

As shown in FIG. 1 and FIG. 2, the engine 31 includes a pair of cylinder heads 33 that provide the left bank and the right bank, respectively, a cylinder block 32 to which these cylinder heads 33 are fixed, and a cam cap plate 34 serving as a beam member and fixed to each of the cylinder heads 33. A camshaft 35 for intake valves and a camshaft 36 for exhaust valves, that extend in parallel relationship with each other, are mounted in each of the cylinder heads 33, and rotatably held or supported by the cam cap plate 34.

In each of the left and right banks of the engine 31, a cam sprocket 37 is fixedly connected to one axial end of the camshaft 35 for intake valves, and a cam sprocket 38 is fixedly connected to one axial end of the camshaft 36 for exhaust valves. Further, a crank sprocket 40 is fixedly connected to one end of a crankshaft 39. A timing belt 41 is hung around these cam sprockets 37, 38 and crank sprocket 40. With this arrangement, when the engine 31 operates to rotate the crankshaft 39, the driving force is transmitted from the engine 31 to the camshafts 35 for intake valves and the camshafts 36 for exhaust valves, through the crank sprocket 40, so that the camshafts 35, 36 are rotated in synchronization with each other. The cam sprockets 37, 38, crank sprocket 30, and the timing belt 41 are covered with a timing belt cover 70 having three sections, and this timing belt cover 70 is adhered to and held by end faces of rocker covers 42 that are fixed to the cam cap plates 34 of the left and right banks of the engine.

The rocker cover 42 attached to each bank of the engine is supported in a floating state above the upper face of the corresponding cam cap plate 34, with a seal member 63 interposed between the cover 42 and the cap plate 34. The rocker cover 42 is provided with an outlet 43 through which blow-by gas is ejected out of the cylinder block 32. Namely, an upper space of the cylinder head 33, which is defined by the cylinder head 33, cam cap plate 34, and the rocker cover 42, is connected to and communicates with an intake system through this outlet 43. In this arrangement, blow-by gas that leaks into the cylinder block 32 passes through the upper space of the cylinder block 33, and is sent to the intake system through the outlet 43, so that the blow-by gas is mixed with new air, and the resulting mixture is introduced again into the combustion chamber, to be burned in the chamber.

Each of the combustion chambers 44 formed in the cylinder head 33 communicates with intake ports 45 and exhaust ports 46, and distal ends of the intake valves 47 and exhaust valves 48 are located at corresponding ends of the intake ports 45 and exhaust ports 46 at which they are open to the combustion chamber 44. By driving the intake valves 47 and exhaust valves 48 in the vertical direction, therefore, the intake ports 45 and exhaust ports 46 are opened and closed with respect to the combustion chamber 44. The intake ports 45 extend substantially upright, to be open to intake holes 53 formed through a central portion 56 of the cam cap plate 34, while the exhaust ports 46 extend sideways, to be open to side faces of the cylinder head 33. An intake manifold 54 is mounted on the cam cap plate 34 so as to communicate with the intake holes 53 and intake ports 45, such that a flange 55 of the intake manifold 54 rigidly engages with the upper face of the central portion 56 of the cam cap plate 34, so as to surround each of the intake holes 53.

Intake cam chamber 49 and exhaust cam chamber 50 are formed independently of each other on the opposite sides of the central portion 56 of the cam cap plate 34. The above-described camshaft 35 for intake valves and the camshaft 36 for exhaust valves are disposed in the intake cam chamber 49 and the exhaust cam chamber 50, respectively. Intake cams 51 and exhaust cams 52, having given lift amounts for each cylinder, are formed integrally with the camshaft 35 for the intake valves and the camshaft 36 for the exhaust valves, respectively.

As shown in FIG. 2, rocker arms 57, 58, corresponding to each pair of intake and exhaust valves 47, 48, are mounted in the cylinder head 33, and the corresponding intake cam 51 and exhaust cam 52 cause the rocker arms 57, 58 to pivot about respective ends of lash adjusters 59, 60 as hydraulically operated portions. Distal ends of the rocker arms 57, 58 abut the upper ends of the intake valve 47 and exhaust valve 48, respectively, and the intake valve 47 and exhaust valve 48 are driven up and down due to pivotal movements of the respective rocker arms 57, 58.

The cam cap plate 34 will be now explained in detail. As shown in FIG. 3, the cam cap plate 34 assumes a frame-like shape, and is fixed onto the cylinder head 33. The cam cap plate 34 includes a plurality of cap portions 61 located in the respective cam chambers 49, 50. These cap portions 61 are fixed to support portions of the cylinder head 33 with the respective camshafts 35, 36 being interposed between the cap portions 61 and the cylinder head 33, such that the camshafts 35, 36 are rotatably supported. For each cylinder of the engine, the central portion 56 of the cam cap plate 34 is provided with a plug mount hole 62 for mounting a spark plug and a pair of intake holes 53. As described above, the intake manifold 54 is fixed to the central portion 56 of the cam cap plate 34, for communication with the intake ports 45 through the intake holes 53.

As shown in FIG. 2, the rocker cover 42 is supported in a floating state over the upper face of the cam cap plate 34, with the seal member 63 interposed between the cover 42 and the cap plate 34. Namely, the rocker cover 42 is supported in a floating state with respect to the cam cap plate 34 as part of the main body of the engine 31, and the intake manifold 54 is rigidly attached to or mounted on the cam cap plate 34, through a central portion of the rocker cover 42.

In the engine of the present embodiment, oil passages are provided which supply oil from an oil pressure source to journal portions of the camshaft 35 for the intake valves and the camshaft 36 for the exhaust valves, and to the hydraulic lash adjusters 59, 60. These oil passages have air vent holes formed at their downstream end portions.

More specifically described by referring to FIG. 2 and FIG. 4, a first oil path 81 having a U shape as seen in the plan view of FIG. 4 is formed through an outer peripheral portion of the cylinder head 33. This first oil path 81 communicates with a channel 83 which leads to an oil pump 82 through an orifice 93 serving as a flow restricting member, as shown in FIG. 5. This first oil path 81 also communicates with a plurality of branch paths 84 which lead to journal portions of the camshaft 35 for the intake valves and camshaft 36 for the exhaust valves. In this arrangement, the oil flowing into the first oil path 81 is supplied to the journal portions of the respective camshafts 35, 36, through the corresponding branch paths 84.

The oil passage structure of the present embodiment further includes two second oil paths 85 as oil passages, which are formed in the central portion of the cylinder head 33 to extend in parallel with the camshaft 35 for the intake valves and the camshaft 36 for the exhaust valves. The oil flowing into the second paths 85 is supplied to the respective lash adjusters 59, 60.

A first inlet 86 which is open to the upper face of the cylinder head 33 is formed at an upstream portion (upper end portion in FIG. 4) of each of the second oil paths 85. On the other hand, an end hole 87, which is open to the upper face of the cylinder head 33, is formed at a downstream portion (lower end portion in FIG. 4) of each second oil path 85. Also, a communication hole 88, which is open to the upper face of the cylinder head 33, is formed at a downstream portion of the first oil path 81.

As shown in FIG. 3, the cam cap plate 34 is formed with a third oil path 89 that serves as an oil inlet passage. A second inlet 90 that leads to the communication hole 88 of the cylinder head 33, shown in FIG. 4, is formed at an upstream end portion of the third oil path 89, and outlet ports 91 that lead to the first inlets 86 of the second oil path 85, shown in FIG. 4, are formed at a downstream end portion of the third oil path 89. Further, the cam cap plate 34 is formed with air vent passages 92 that lead to the end holes 87 of the cylinder head 33, such that the openings of the air vent passages 92 that are open on the upper surface of the cam cap plate 34 are located at higher positions than the second oil paths 85 of the cylinder head 33.

In the above-described arrangement shown in FIGS. 2–4, the oil supplied from the oil pump 82 to the first oil path 81 through the channel 83 passes through the communication hole 88 of the cylinder head 33 and the second inlet 90 of the cam cap plate 34, and thus introduced into the third oil path 89 located at a higher position than the second paths 85. The oil in the third oil path 89 flows through the outlet ports 91 and the first inlets 86 of the cylinder head 33, to be transmitted to the two second oil paths 85. The oil flowing into the respective second oil paths 85 is then supplied to the lash adjusters 59, 60. If air is mixed into the oil in the second oil paths 85, the air in the second oil paths 85 passes through the end holes 87 and the air vent passages 92, thereby to be ejected out of the cam chambers through the openings of the passages 92.

The flow of the oil in the oil passages of the engine 31, as described above, will be now explained in detail. When the engine 31 is started, the oil pump 82 is activated, and a suitable amount of oil, which is controlled by the orifice 93, is fed to the first oil path 81 on the side of the cylinder head 33, through the channel 83, as shown in FIG. 5 and FIG. 6. The oil flowing into the first oil path 81 is then supplied from the plurality of branch paths 84 to respective journal portions of the camshaft 35 for intake valves and the camshaft 36 for exhaust valves. The oil in the first oil path 81 also flows into the third oil path 89, through the communication hole 88 on the side of the cylinder head 33 and the second inlet 90 on the side of the cam cap plate 34. The oil sent to the third oil path 89 is divided into two branch paths, and flows into the second oil paths 85, through the respective outlet ports 91 on the side of the cam cap plate 34 and the inlets 86 on the side of the cylinder block 32, to be supplied to the plurality of lash adjusters 59, 60.

Subsequently, the oil in the second oil paths 85 flows toward the downstream side, and introduced from the end holes 87 into the air vent passages 92 on the side of the cam cap plate 34. In the case where air is mixed into the oil, the oil and the air are ejected from the openings at the upper ends of the air vent passages 92, into the intake cam chamber and exhaust cam chamber.

When the engine 31 is stopped, the oil in the first oil path 81 and the oil in the third oil path 89 slowly return to a drain tank or reservoir that is not illustrated, through the orifice 93 and channel 83. The oil in the second oil paths 85, however, remains in the second oil paths 85 and does not return to the channel 83 through the first oil path 81, since the oil was originally supplied from the third oil path 89 formed in the cam cap plate 34 and located at a higher position than the second oil path 85.

In the oil passage structure of the engine of the present embodiment as described above, the oil is introduced from the third oil path 89, provided at a higher position than the second oil paths 84, into the second oil paths 85 for supplying the oil to the lash adjusters 59, 60, whereby the oil remains in the second oil paths 85 even when the engine 31 is stopped, ensuring that the oil is kept supplied to the lash adjusters 59, 60. As shown in FIG. 2, the cylinder head 33 of the left bank of the engine 31 is installed on the vehicle, such that it is inclined by about 60 degrees, for example, with respect to the right bank of the cylinder block 33 of the engine 31. In this case, since the height Y of the third oil path 89 is greater than the height X of the second oil paths 85, namely, the third oil path 89 is located at a higher position than the second oil paths 85, the oil in the second oil paths 85 is prevented from flowing back to the third oil path 89. When the engine 31 is started again, therefore, the oil can be immediately supplied to the lash adjusters 59, 60, without waiting for supply of the oil from the oil pump 82, thereby avoiding a delay in supplying the oil and undesirable noises upon starting of the engine.

In the oil passage structure of the engine of the present embodiment, the oil in the second oil paths 85 flows through the end holes 87 into the air vent passages 92 formed on the side of the cam cap plate 34. With this arrangement, even if air is mixed into the oil in the second oil paths 85, the air can be surely ejected from the upper-end openings of the air vent passages 92, and thus the air is prevented from entering the lash adjusters 59, 60 and causing undesirable noises.

In the present embodiment in which the third oil path 89 and air vent passages 92 are formed in the cam cap plate 34, the oil paths formed in the cylinder head 33 need not be changed even if the angle of installation of the engine 31 is changed, namely, changes in the angle of installation of the engine 31 can be dealt with only by changing the position or shape of the oil paths formed in the cam cap plate 34. This eliminates a need to change the cylinder head 33, or significantly change the design or structure of the engine 31, which leads to reduction in the cost.

With the orifice 93 provided in the channel 83, the oil in the first oil path 81 returns to the drain tank at a reduced rate when the engine 31 is stopped, and therefore the oil in the second oil paths 85 and third oil path 89 is prevented from returning to the channel 83 due to a siphonic phenomenon.

In the illustrated embodiment, the third oil path 89 serving as an oil inlet passage is formed in the cam cap plate 34 located at a higher position than the second oil paths 85, and the air vent passages 92 are also formed in the cam cap plate 85 located at a higher position than the second oil paths 85. It is, however, possible to form the third oil path 89 and air vent passages 92 in the cylinder head 33 provided that the passages 89, 92 are located at a higher position than the second oil paths 85. As another modified example, either the third oil path 89 or the air vent passages 92 may be formed in the cam cap plate 34.

The type of engine that employs the oil passage structure of the present invention, as described above, is not limited to V-shaped, six-cylinder, direct fuel injection type DOHC engines, such as one in the illustrated embodiment, in which a pressurized fuel that is directly injected into each combustion chamber and air that is introduced from intake ports are mixed together and burned in the combustion chamber. Rather, the oil passage structure of the present invention may be employed in other types of engine, such as one in which intake ports and exhaust ports are open to side portions of the cylinder head, and the fuel is injected into intake passages. The arrangement and number of cylinders of the engine are also not limited to those (V-shaped, six cylinders) of the illustrated embodiment, but the present invention may be applied to engines having other arrangement or number of cylinders, such as straight six or straight four engines.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil passage structure of an engine provided with a first oil passage for supplying oil to hydraulically operated portions of a cylinder head of the engine, comprising:

an oil inlet passage that communicates, at a first end thereof, with an upstream portion of the first oil passage, and communicates, at a second end thereof, with an oil pressure source, said oil inlet passage being located at a higher position than said first oil passage; and an air vent passage that communicates, at a first end thereof, with a downstream portion of the first oil passage, and includes an air vent opening formed at a second end thereof, said air vent opening being located at a higher position than the first oil passage.

2. An oil passage structure of an engine according to claim 1, further comprising:

a cam cap attached to an upper portion of the cylinder head, for supporting at least one camshaft, wherein said oil inlet passage and said air vent passage are formed in said cam cap.

3. An oil passage structure of an engine according to claim 1, wherein a second oil passage is provided at an upstream side of said oil inlet passage, and wherein said second oil passage is provided with a flow restricting member.

4. An oil passage structure of an internal combustion engine, comprising:

an oil channel connected to an oil pressure source;

a first oil path connected to said oil channel, said first oil path being provided at a position higher than said oil pressure source;

a second oil path connected to said first oil path, said second oil path being provided at a position higher than said first oil path;

at least one third oil path connected to said second oil path, said third oil path being provided at a position lower than said first oil path; and at least one vent passage, a first end of which being connected to said third oil path and a second end of which being open at a position higher than said second oil path.

5. An oil passage structure according to claim 4, further comprising:

an orifice provided in said oil channel between said oil pressure source and said first oil passage.

6. An oil passage structure according to claim 4, wherein said internal combustion engine includes, a cylinder head, and a cam cap provided on top of said cylinder head, wherein said oil channel, said first oil passage, and said third oil passage are provided in said cylinder head, and said second oil passage and a second end of said vent passage are provided in said cam cap.

7. An oil passage structure according to claim 6, wherein said cylinder head includes at least one cam shaft and at least one lash adjuster, wherein said first oil passage provides oil to said at least one cam shaft and said at least one third oil passage provides oil to said at least one lash adjuster.

* * * * *